US005890688A

United States Patent [19]

Riordan

[11] Patent Number: 5,890,688

[45] Date of Patent: Apr. 6, 1999

[54] DEVICE FOR RELEASABLY MOUNTING A BUSINESS OR CALLING CARD

[76] Inventor: James Riordan, 3110 Camerosa Cir., Cameron Park, Calif. 95682

[21] Appl. No.: 944,091

[22] Filed: Oct. 2, 1997

[51] Int. Cl.[6] ..... A47G 1/17

[52] U.S. Cl. ..... 248/205.3; 40/594

[58] Field of Search ..... 248/205.3, 205.4; 428/40.1; 40/760, 661.09, 594; 281/2

[56] References Cited

U.S. PATENT DOCUMENTS

| | | | |
|---|---|---|---|
| 2,755,576 | 7/1956 | Golden | 248/205.3 |
| 4,605,292 | 8/1986 | McIntosh | 248/205.3 X |
| 4,756,498 | 7/1988 | Frye | 248/205.3 |
| 4,822,074 | 4/1989 | Hueffman et al. | 428/40.1 |

FOREIGN PATENT DOCUMENTS

| | | | |
|---|---|---|---|
| 2702824 | 8/1977 | Germany | 248/205.3 |

*Primary Examiner*—Ramon O. Ramirez
*Attorney, Agent, or Firm*—Thomas R. Lampe

[57] ABSTRACT

A card mounting device for releasably mounting a business or calling card on the surface of a support includes a flexible sheet of paper having adhesive applied to one side thereof on one half of the sheet of paper and adhesive applied to the other side thereof on the other half of the sheet of paper.

1 Claim, 1 Drawing Sheet

DEVICE FOR RELEASABLY MOUNTING A BUSINESS OR CALLING CARD

TECHNICAL FIELD

This invention relates to a device for releasably mounting a business or calling card on a surface of a support, for example, the flat surface of a door or wall, a brochure or letterhead.

BACKGROUND OF THE INVENTION

The business or calling card is in widespread usage by professionals, business persons and others. People are often faced with situations where they are unable to personally present their cards to prospective clients, businesspersons, etc. due to the fact that the intended recipient is away from his or her place of business or home. Cards are often stuck into cracks or crevices at the site so that the occupant upon return will become aware that the person identified on the card has made a call. Cards are often dislodged and lost before arrival of their intended recipients. Adhesive tape, thumbtacks and other expedients have also been used to secure calling or business cards in position, for example, on walls; however, these expedients can mar surfaces and are not always available or convenient for use.

Insofar as brochures and similar items are concerned, slits can be formed therein to accommodate a card. However, cards can be readily accidentally dislodged, for example ending up and lost in the bottom of envelopes.

The device of the present application is for the purpose of temporarily securing a business or calling card at any desired location in a secure manner with the card held flat on a support surface so that accidental dislodgement is minimized. The particular device for accomplishing this includes a flexible sheet of paper. Releasable adhesive material is applied to opposed surfaces of the flexible sheet of paper to secure the sheet of paper to a support surface and a card to the sheet of paper at an opposed side thereof. Of course, it is well known to employ releasable adhesive material on paper sheets to secure the sheet itself to a surface, the sheet typically being utilized to display a note written or printed thereon. Such prior art arrangements, however, are not suitable for mounting calling and business cards in a secure manner and also in a manner which will allow easy removal of the card by an individual when desired.

DISCLOSURE OF INVENTION

The present invention relates to a card mounting device for releasably mounting a business or calling card on the surface of a support. The card mounting device includes a flexible sheet of paper having opposed first and second sheet surfaces, a top edge, a bottom edge spaced from the top edge, and a pair of side edges.

The side edges are spaced from one another and extend between the top and bottom edges.

Releasable adhesive material is on the first sheet surface only in an area located between the top edge and an imaginary dividing line extending between the side edges between the top edge and bottom edge. Releasable adhesive material is also on the second sheet surface, only in an area located between the bottom edge and the imaginary dividing line. The card is held close to and parallel to the sheet of paper and support surface.

Use of the invention will cause the paper to automatically "lift off" either the card or the support surface to which the card has been applied, in such a manner that an edge of the paper sticks up and is easily grasped to remove the paper without having to use a fingernail to try to peel it off.

Other features, advantages, and objects of the present invention will become apparent with reference to the following description and accompanying drawings.

BEST MODE FOR CARRYING OUT THE INVENTION

Figure 1:
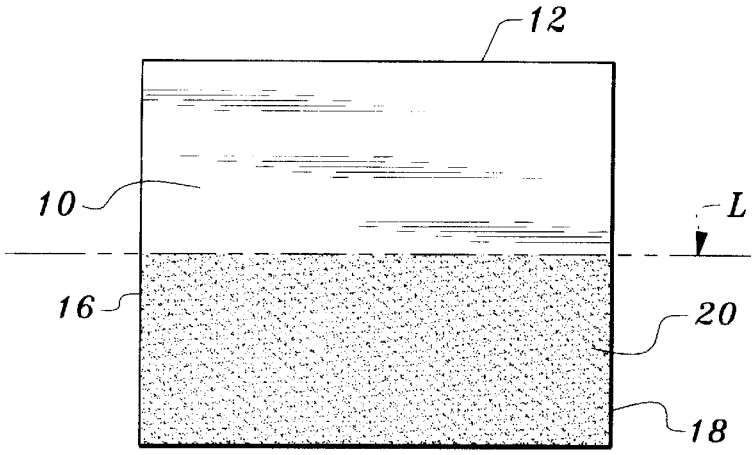
FIG. 1 is a front elevation view of apparatus constructed in accordance with the teachings of the present invention.
Figure 2:
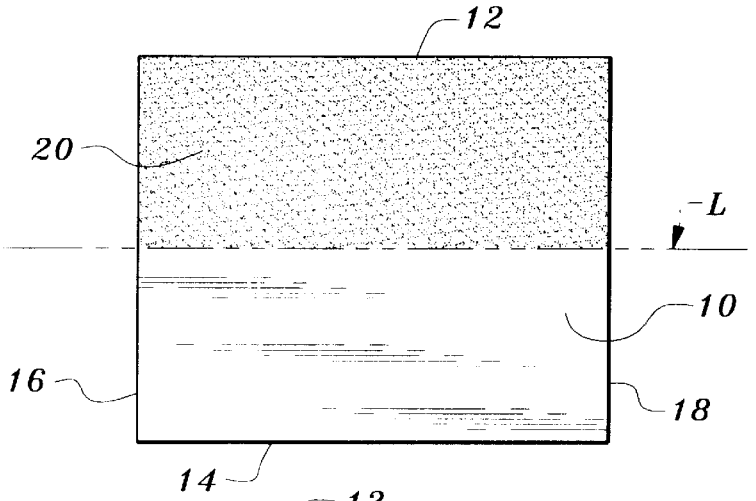
FIG. 2 is a rear elevation view of the device of the present invention.

Referring now to the drawings, the device of the present invention includes a flexible sheet of paper 10 having a generally rectangular configuration. The sheet has opposed first and second sheet surfaces, the front surface illustrated in FIG. 1 and the rear surface illustrated in FIG. 2.

The sheet includes a top edge 12, a bottom edge 14 spaced from the top edge, and a pair of side edges 16, 18. The side edges are spaced from one another and extend between the top and bottom edges.

Releasable adhesive material 20 is applied to selected areas of the sheet of paper. The releasable adhesive material may be of any suitable type such as that employed with standard note sheets which are temporarily secured to a wall or other surface. An example of such prior art note sheets is that sold under the trademark "Post-It" by 3M of St. Paul, Minn.

At the back side or surface of the sheet in the arrangement illustrated, the releasable adhesive material is applied solely in an area located between the top edge and an imaginary dividing line L extending between the side edges. The line L extends between the side edges mid-way between the top edge and the bottom edge and is parallel to the top and bottom edges. In the arrangement illustrated, the releasable adhesive material 20 covers the entire area between line L and the top edge at the back sheet surface.

The releasable adhesive 20 also is on the front sheet surface. The adhesive on the front sheet surface is located in an area of the sheet defined by imaginary line L and the bottom edge between the two side edges. The portion of the sheet above imaginary line L is free of adhesive in the same manner that the portion of the sheet below imaginary line L is free of adhesive on the back side of the sheet. The releasable adhesive material substantially covers all of both of the areas but the releasable adhesive material on one of the sheet surfaces does not overlap the releasable adhesive material on the other of the sheet surfaces.

Figure 3:
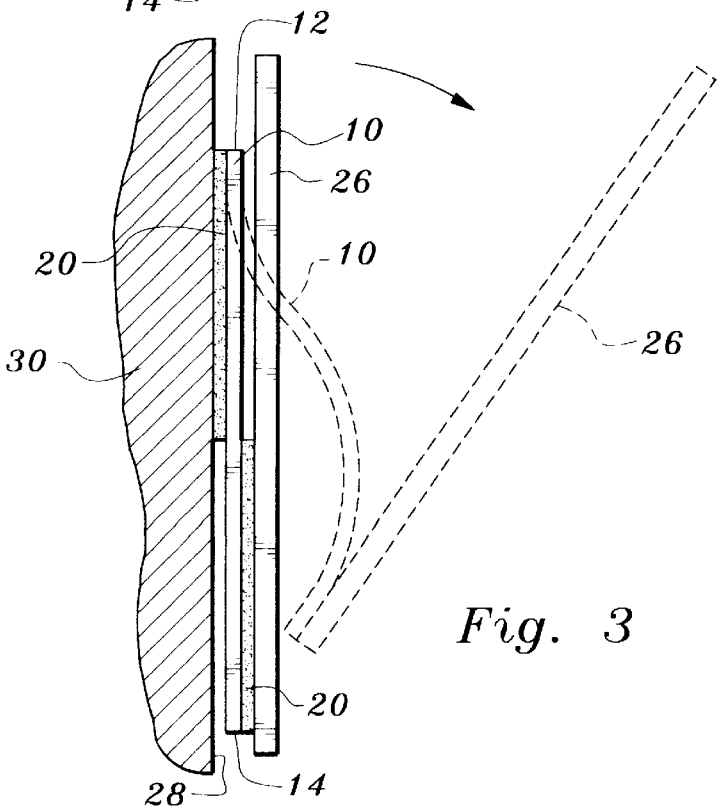
FIG. 3 illustrates the device in position on the flat surface of a support and showing a business card secured in place on the sheet of paper and support.

FIG. 3 illustrates a business card 26 being held by the above-described device on the flat surface 28 of any support such as wall 30. At the upper end thereof the back side or surface of sheet 10 is releasably secured to the flat surface 28 by the releasable adhesive material 20 in that area of the sheet. The card 26 is releasably secured to the front surface of the sheet of paper at the lower half of the sheet by the releasable adhesive material in that area.

The releasable adhesive material and the flexible sheet of paper are cooperable with the card to maintain the card substantially parallel to the flexible sheet of paper and the support surface when the flexible sheet of paper has a flat configuration, as depicted by the solid line representation in FIG. 3.

It will be appreciated that the card may be readily removed from its mounted position by manually grasping the card and pulling it away from the support surface. Pushing up on the card or the flexible sheet of paper will move the flexible sheet to the bent configuration illustrated by dash lines in FIG. 3. This, in turn, will cause the top edge of the card to move outwardly and away from the support as shown by the arrow in FIG. 3 so that manual grasping of the card by an individual to remove a card will be facilitated and at the same time, the paper is easier to remove from the card or surface since one edge is now raised.

I claim:

1. A card mounting device for releasably mounting a business or calling card on the surface of a support, said device comprising a flexible sheet of paper of rectangular configuration having opposed first and second sheet surfaces, a top edge, a bottom edge spaced from said top edge, and a pair of side edges, said side edges being spaced from one another and extending between said top and bottom edges, and releasable adhesive material on said first sheet surface only in an area located between said top edge and an imaginary dividing line extending between said side edges between said top edge and bottom edge and on said second sheet surface only in an area located between said bottom edge and said imaginary dividing line, said flexible sheet of paper being free of perforations between said top and bottom edges, said imaginary line extending between said side edges generally mid-way between said top edge and said bottom edge and being substantially parallel to said top and bottom edges, said releasable adhesive material substantially covering all of both of said areas and the releasable adhesive material on each of said sheet surfaces not overlapping the releasable adhesive material on the other of said sheet surfaces, the releasable adhesive material on one of said sheet surfaces for engagement with the surface of a support and the releasable adhesive material on the other of said sheet surfaces for engagement with a card, said releasable adhesive material and said flexible sheet of paper cooperable with a card when a card is mounted thereon to maintain said card substantially parallel to said flexible sheet of paper and to said support surface when said flexible sheet of paper has a flat configuration, and said flexible sheet Of paper when in a bent configuration due to the application of an outside force applied thereto being operable to maintain a portion of the card away from the support surface to facilitate manual grasping of the card.

* * * * *